US006254296B1

(12) United States Patent
Sheu

(10) Patent No.: US 6,254,296 B1
(45) Date of Patent: Jul. 3, 2001

(54) AUTOMATIC PENCIL STRUCTURE

(76) Inventor: Rong-Lin Sheu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/685,188

(22) Filed: Oct. 6, 2000

(51) Int. Cl.[7] ..... B43K 21/22
(52) U.S. Cl. ..... 401/92; 401/86
(58) Field of Search ..... 401/92, 93, 94, 401/86, 65, 67

(56) References Cited

U.S. PATENT DOCUMENTS 2,596,234 * 5/1952 Gartenmann ..... 401/93
3,836,264 * 9/1974 Saito et al. ..... 401/92
4,056,325 * 11/1977 Maruyama ..... 401/93

* cited by examiner

*Primary Examiner*—David J.. Walczak

(57) ABSTRACT

An automatic pencil structure includes a barrel, a tip cover, a connecting barrel, and a conducting tube. The barrel is provided with an inner thread screwed on an outer thread of the connecting barrel. The tip cover has a rear portion provided with a sleeve fitted in the connecting barrel and a front portion receiving the slide member. The slide member has a front portion protruding outward from the tip cover and a rear portion including a retaining ring for retaining the pencil lead by a friction action. The clip member has two opposite sides each defining an arcuate recess receiving a ball. The clamp ring is enclosed around the clip member has a bottom defining an inclined surface urged on the ball and a top defining a locking hole for securing the conducting tube and a pencil lead hole allowing passage of the pencil lead. The conducting tube defines a passage for receiving the pencil lead. The passage is connected to the pencil lead hole of the clamp ring and has a top defining an inner curved portion.

1 Claim, 9 Drawing Sheets

AUTOMATIC PENCIL STRUCTURE

BACKGROUND OF THE INVENTION

1. Field of the Invention

The present invention relates to an automatic pencil structure.

2. Description of the Related Art

A conventional automatic pencil structure in accordance with the prior art shown in FIGS. 1 and 2 comprises a tip cover 90 having a smooth outer inclined surface 902, a connecting barrel 91 formed on the tip cover 90 and fitted in a barrel (not shown), a slide member 92 slidably mounted in the tip cover 90, a pencil lead 93, a retaining ring 94 for retaining the pencil lead 93, a clip member 95 defining a holding portion 950 for holding the pencil lead 93 and having two sides each defining a recess 952 for receiving a ball 954, a clamp ring 96 mounted around the clip member 95, and a spring 98 mounted between the clip member 95 and the slide member 92.

In use, the pencil lead 93 is pushed outward automatically by the reaction on the slide member 92 exerted by the paper without needing any pressing or operation action.

However, the inner diameter of the holding portion 950 of the clip member 95 is greater than the outer diameter of the pencil lead 93 so that multiple pencil leads 93 are easily blocked in the holding portion 950 of the clip member 95 as shown in FIG. 2, thereby breaking the pencil leads 93. In addition, the connecting barrel 91 of the tip cover 90 is fitted in the barrel, and the outer inclined surface 902 of the tip cover 90 is smooth so that the connecting barrel 91 of the tip cover 90 is not easily detached from the barrel, thereby causing inconvenience in replacing the pencil leads 93.

SUMMARY OF THE INVENTION

The present invention has arisen to mitigate and/or obviate the disadvantage of the conventional automatic pencil structure.

In accordance with one aspect of the present invention, there is provided an automatic pencil structure comprising:

a barrel, a tip cover, a connecting barrel, a slide member, a spring, a pencil lead, a clip member, a clamp ring, and a conducting tube, wherein, the barrel is provided with an inner thread;

the tip cover has a rear portion provided with a sleeve fitted in the connecting barrel and a front portion for receiving the slide member;

the connecting barrel is provided with an outer thread screwed in the inner thread of the barrel, the connecting barrel having a top defining a conducting hole for receiving the conducting tube;

the slide member having a front portion protruding outward from the front portion of the tip cover and defining a through hole for receiving the pencil lead and a rear portion including a retaining ring mounted therein for retaining the pencil lead by a friction action;

the clip member is located above the slide member and defines a holding portion for holding the pencil lead therein, the clip member having two opposite sides each defining an arcuate recess for receiving a ball;

the spring is mounted between the slide member and the clip member and has a front portion secured on the retaining ring of the slide member and a rear portion secured on the clip member;

the clamp ring is secured in the sleeve of the tip cover and is enclosed around an outer periphery of the clip member, the clamp ring having a bottom defining an inner inclined surface urged on the ball and a top defining a locking hole for securing a lower portion of the conducting tube, the locking hole having a bottom having a center defining a pencil lead hole for allowing passage of the pencil lead; and the conducting tube is secured in the conducting hole of the connecting barrel and has its lower portion secured in the locking hole of the clamp ring, the conducting tube defining a passage for receiving the pencil lead therein, the passage connecting to the pencil lead hole of the clamp ring and having a top defining an inner curved portion.

Further benefits and advantages of the present invention will become apparent after a careful reading of the detailed description with appropriate reference to the accompanying drawings.

DETAILED DESCRIPTION OF THE INVENTION

Figure 1:
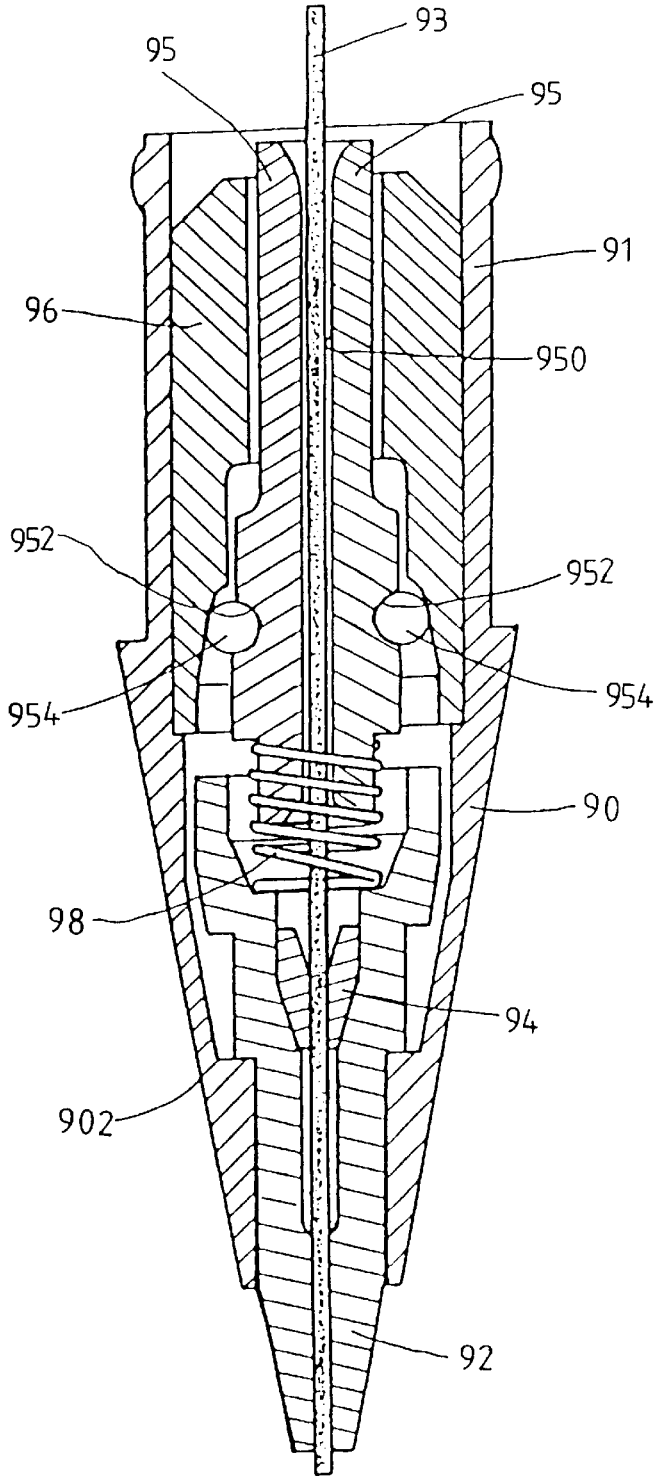
F I G. 1 PRIOR ART
FIG. 1 is a front plan cross-sectional assembly view of a conventional automatic pencil structure in accordance with the prior art.
Figure 2:
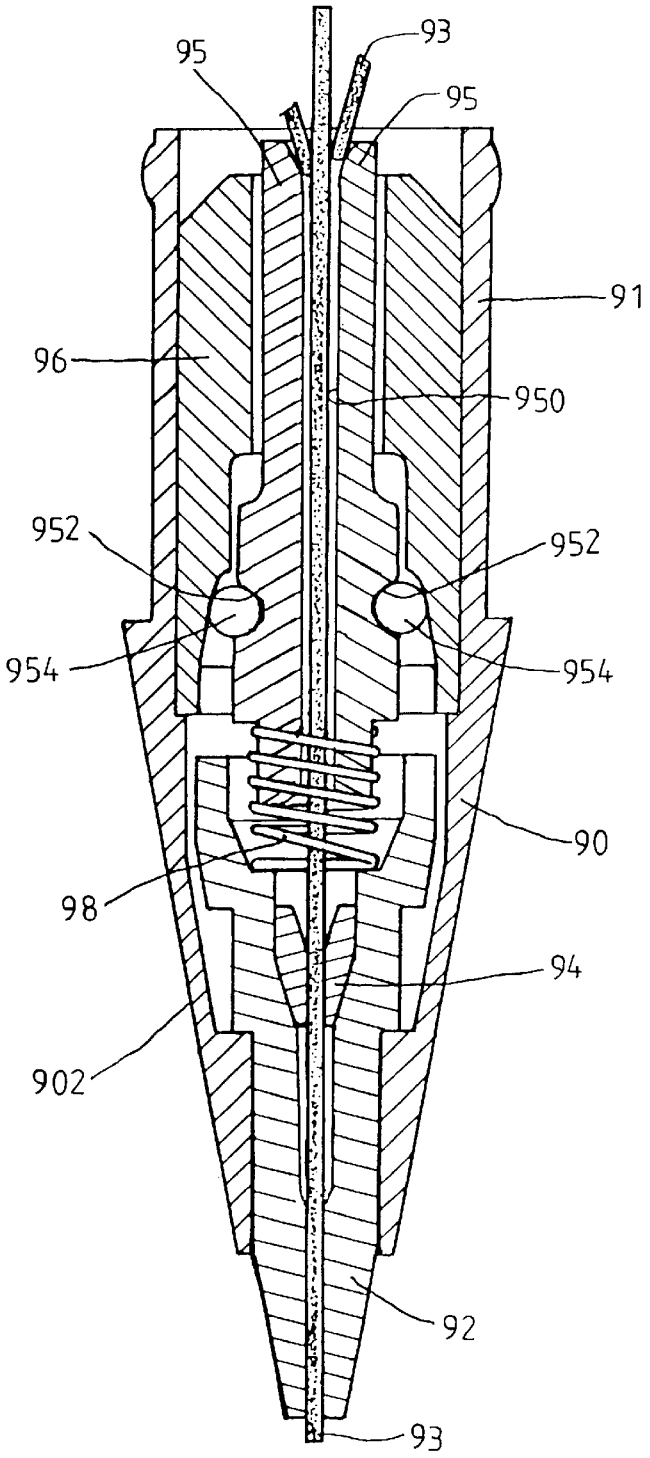
F I G. 2 PRIOR ART
FIG. 2 is an operational view of the conventional automatic pencil structure as shown in FIG. 1.
Figure 3:
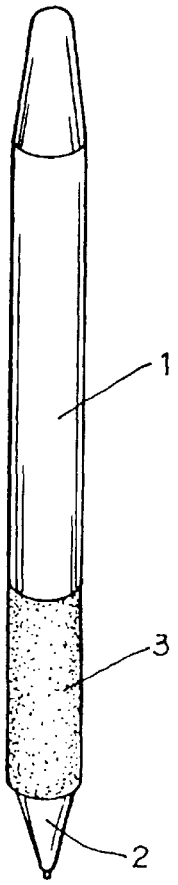
FIG. 3 is a perspective view of an automatic pencil structure in accordance with the present invention.
Figure 5:
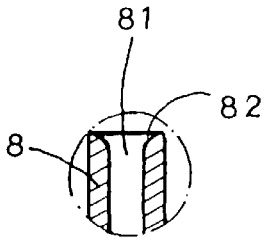
FIG. 5 is a cross-sectional view of a conducting tube of the automatic pencil structure as shown in FIG. 3.
Figure 4:
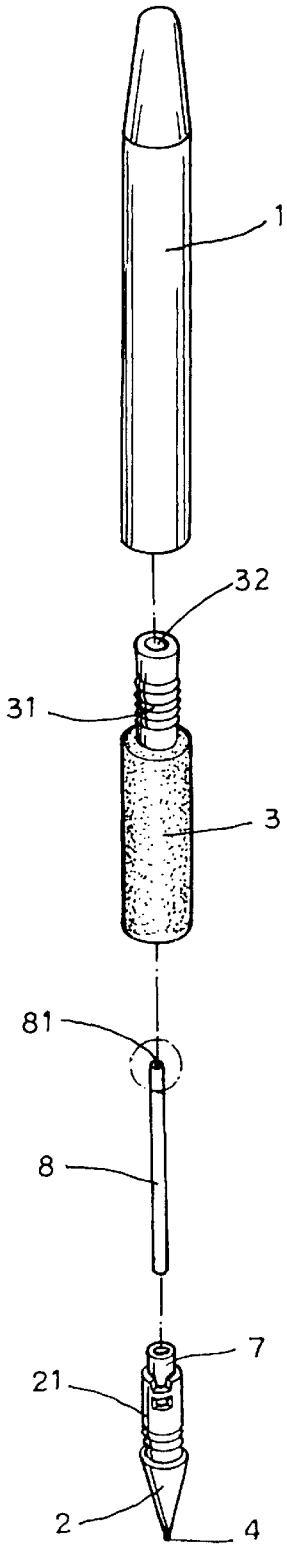
FIG. 4 is a partially exploded view of the automatic pencil structure as shown in FIG. 3.

Referring to the drawings and initially to FIGS. 3–7, an automatic pencil structure in accordance with the present invention comprises a barrel 1, a tip cover 2, a connecting barrel 3, a slide member 4, a spring 43, a pencil lead 5, a clip member 6, a clamp ring 7, and a conducting tube 8.

The barrel 1 is provided with an inner thread 11.

The tip cover 2 has a rear portion provided with a sleeve 21 fitted in the connecting barrel 3 and a front portion for receiving the slide member 4. The front portion of the tip cover 2 is formed with an inner flange 22. The slide member 4 is formed with an outer flange 45 rested on the inner flange 22 of the tip cover 2.

The connecting barrel 3 is provided with an outer thread 31 screwed in the inner thread 11 of the barrel 1 so that the connecting barrel 3 can be detached from the barrel 1 easily.

The connecting barrel 3 has a top defining a conducting hole 32 for receiving the conducting tube 8 therein.

The slide member 4 has a front portion protruding outward from the front portion of the tip cover 2 and defining a through hole 44 for receiving the pencil lead 5 and a rear portion including a retaining ring 41 mounted therein for retaining the pencil lead 5 by a friction action. The slide member 4 defines a recess 42 for receiving the spring 43 therein.

The clip member 6 is located above the slide member 4 and defines a holding portion 61 for holding the pencil lead 5 therein. The clip member 6 has two opposite sides each defining an arcuate recess 62 for receiving a ball 63.

The spring 43 is mounted between the slide member 4 and the clip member 6 and has a front portion secured on the retaining ring 41 of the slide member 4 and located in the recess 42, and a rear portion secured on the clip member 6.

The clamp ring 7 is secured in the sleeve 21 of the tip cover 2 and is enclosed around the outer periphery of the clip member 6. The clamp ring 7 has a bottom defining an inner inclined surface 71 urged on the ball 63 and a top defining a locking hole 72 for securing the lower portion of the conducting tube 8. The locking hole 72 has a bottom having a center defining a pencil lead hole 73 for allowing passage of the pencil lead 5.

The conducting tube 8 is secured in the conducting hole 32 of the connecting barrel 3 and has its lower portion secured in the locking hole 72 of the clamp ring 7. The conducting tube 8 defines a passage 81 for receiving the pencil lead 5 therein. The passage 81 is connected to the pencil lead hole 73 of the clamp ring 7 and has a top defining an inner curved portion 82 facilitating passage of the pencil lead 5.

Figure 6:
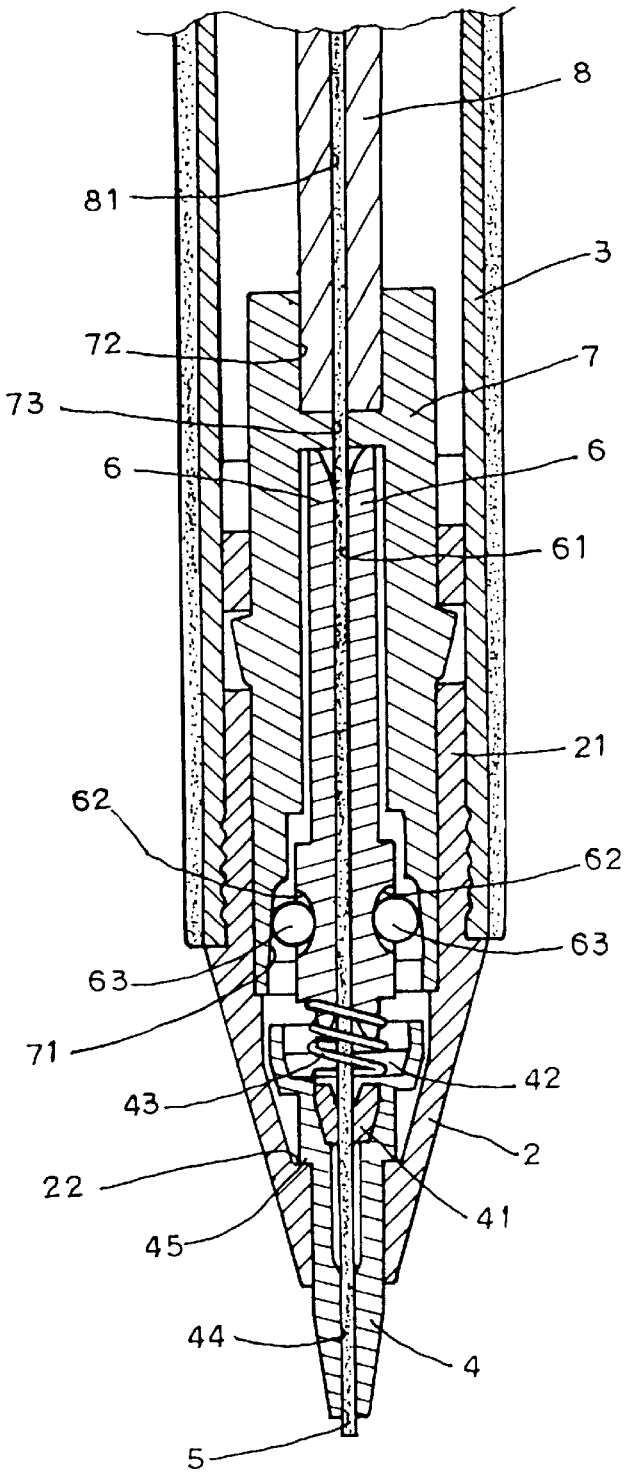
FIG. 6 is a partially cut-away front plan cross-sectional view of the automatic pencil structure as shown in FIG. 3.
Figure 7:
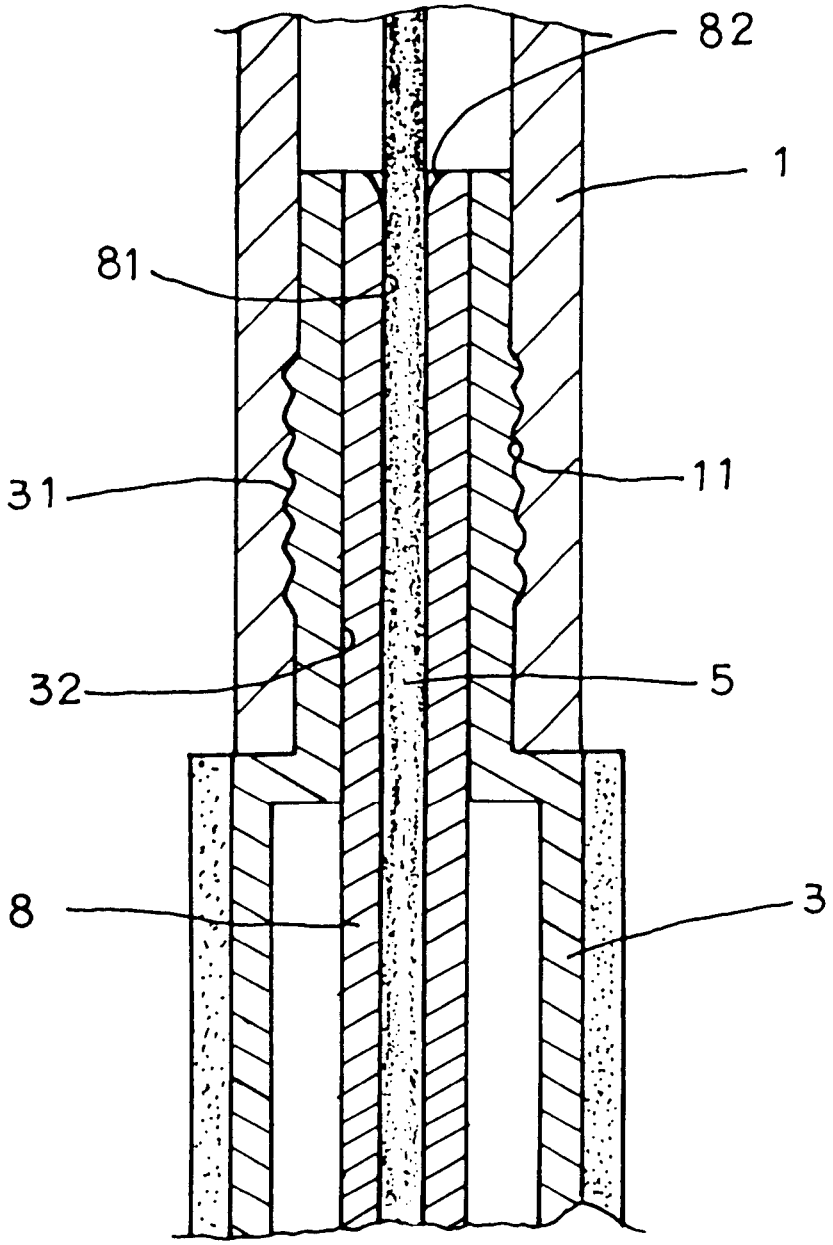
FIG. 7 is a partially cut-away front plan cross-sectional view of the automatic pencil structure as shown in FIG. 3.

In use, the pencil lead 5 is pushed outward automatically by the reaction on the slide member 4 exerted by the paper without needing any pressing or operation action. The clamp ring 7, the inner inclined surface 71, the balls 63, and the clip member 6 allows the pencil lead 5 to move toward the tip cover 2 only, and the pencil lead 5 cannot be moved backward. Referring to FIG. 6, when the pencil lead 5 is moved backward, the clip member 6 is moved upward with the pencil lead 5 through a little distance by friction between the holding portion 61 and the pencil lead 5, whereby the ball 63 is moved upward with the clip member 6 along the inner inclined surface 71, to slide into the narrower portion of the inner inclined surface 71, so that the ball 63 exerts a radially inward urging force to compress the clip member 6, so as to tightly clamp the pencil lead 5 and position the pencil lead 5 in place, thereby preventing the pencil lead 5 from moving backward by the clamping effect of the clip member 6. When the slide member 4 is subjected to the reaction exerted by the paper, the pencil lead 5 is pulled downward by means of the slide member 4, the retaining ring 41, and the spring 43 to move through an appropriate length which is equal to the distance of movement of the slide member 4. The slide member 4 is retracted into the tip cover 2 when the slide member 4 is subjected to the reaction exerted by the paper. Thus, the retaining ring 41 and the pencil lead 5 are slightly moved upward with the slide member 4. The pencil lead 5 cannot be moved backward due to the clamping effect of the clip member 6, which overcomes the grip of the retaining member 41 on the pencil lead 5 when the slide member 4 is retracted into the tip cover 2, so that only the retaining member 41 is moved upward with the slide member 4. Then, the pencil lead 5 is pulled downward by means of the slide member 4, the retaining ring 41, and the spring 43 so as to dispense the pencil lead 5. When the pencil lead 5 is at a stationary state, it is only subjected to the gravity force without any external force being exerted thereon. At the same time, the friction resistance of the retaining ring 41 overcomes the gravity so that the pencil lead 5 will not slip downward.

The connecting barrel 3 can be easily detached from the barrel 1 so that the pencil lead 5 can be inserted into the passage 81 of the conducting tube 8 through guidance of the inner curved portion 82, and can then be introduced into the pencil lead hole 73 of the clamp ring 7, thereby assembling the pencil structure easily and rapidly. The inner diameter of each of the passage 81 and the pencil lead hole 73 is equal to the outer diameter of the pencil lead 5 so that only one pencil lead 5 can pass through the passage 81 and the pencil lead hole 73.

Figure 8:
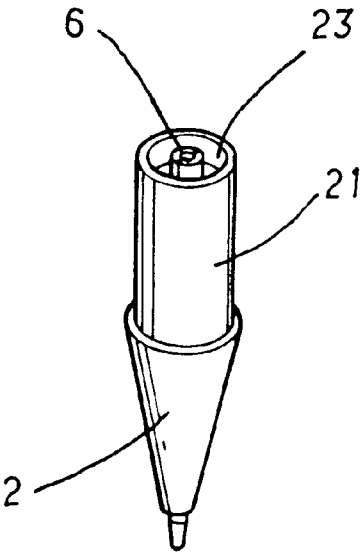
FIG. 8 is a perspective view of a tip cover of the automatic pencil structure in accordance with another embodiment of the present invention.
Figure 9:
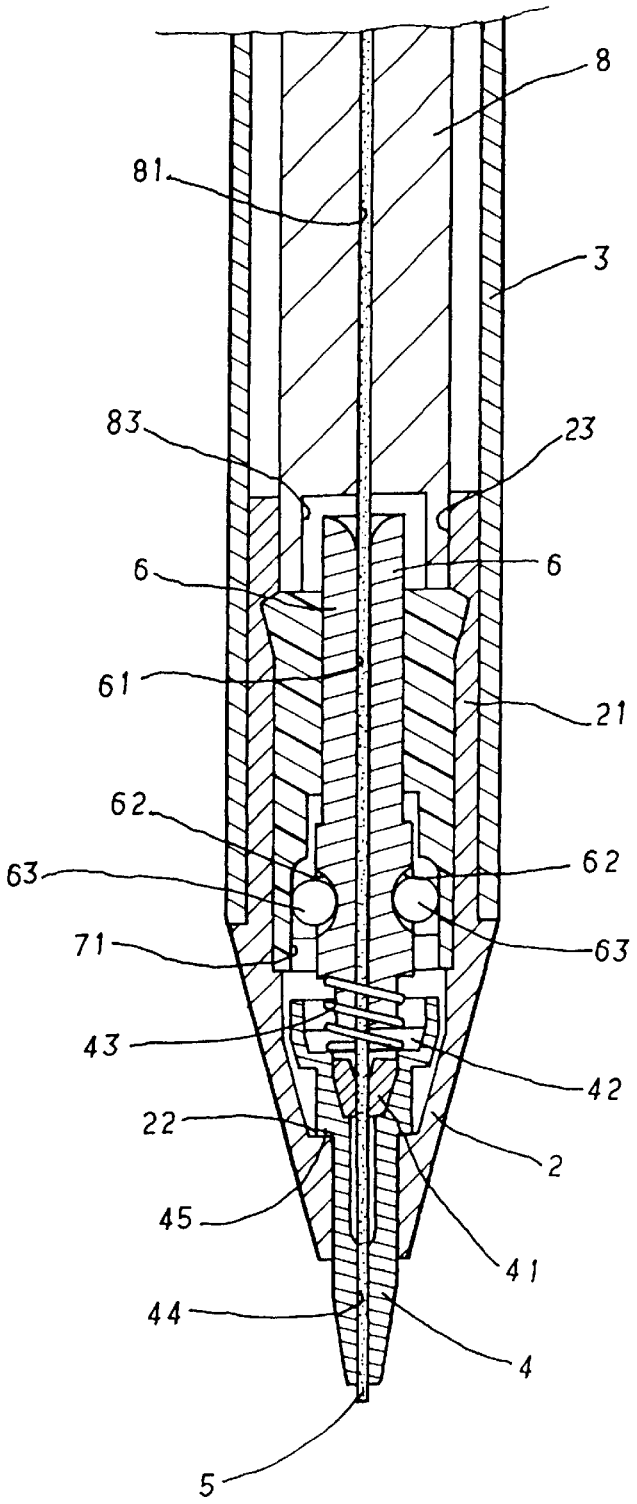
FIG. 9 is a front plan cross-sectional view of the automatic pencil structure in accordance with the embodiment of the present invention.

Referring to FIGS. 8 and 9, in accordance with another embodiment of the present invention, when the clamp ring 8 is secured in the sleeve 21 of the tip cover 2, the inner side of the top of the sleeve 21 defines a locking hole 23, and the bottom of the conducting tube 8 defines a fitting hole 83 connecting to the passage 81 whereby the conducting tube 8 is secured in the locking hole 23 and the fitting hole 83 is used for securing the clip member 6 so that the conducting tube 8 is rigidly mounted.

Figure 10:
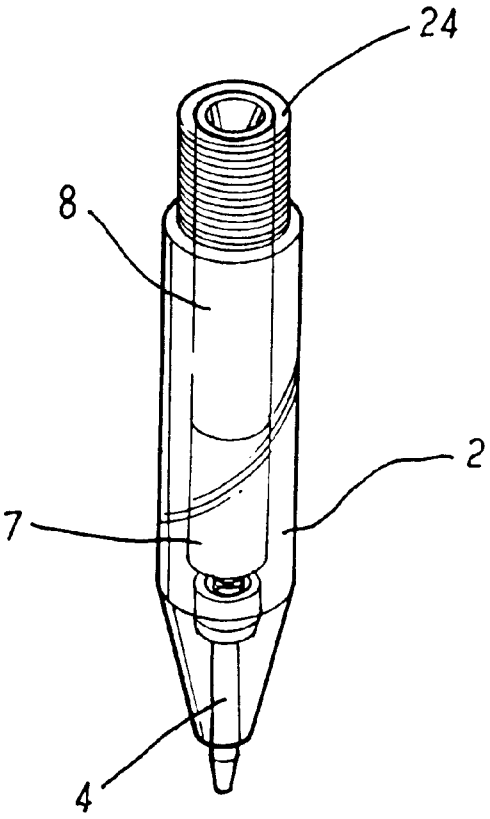
FIG. 10 is a perspective view of a tip cover of the automatic pencil structure in accordance with a further embodiment of the present invention.
Figure 11:
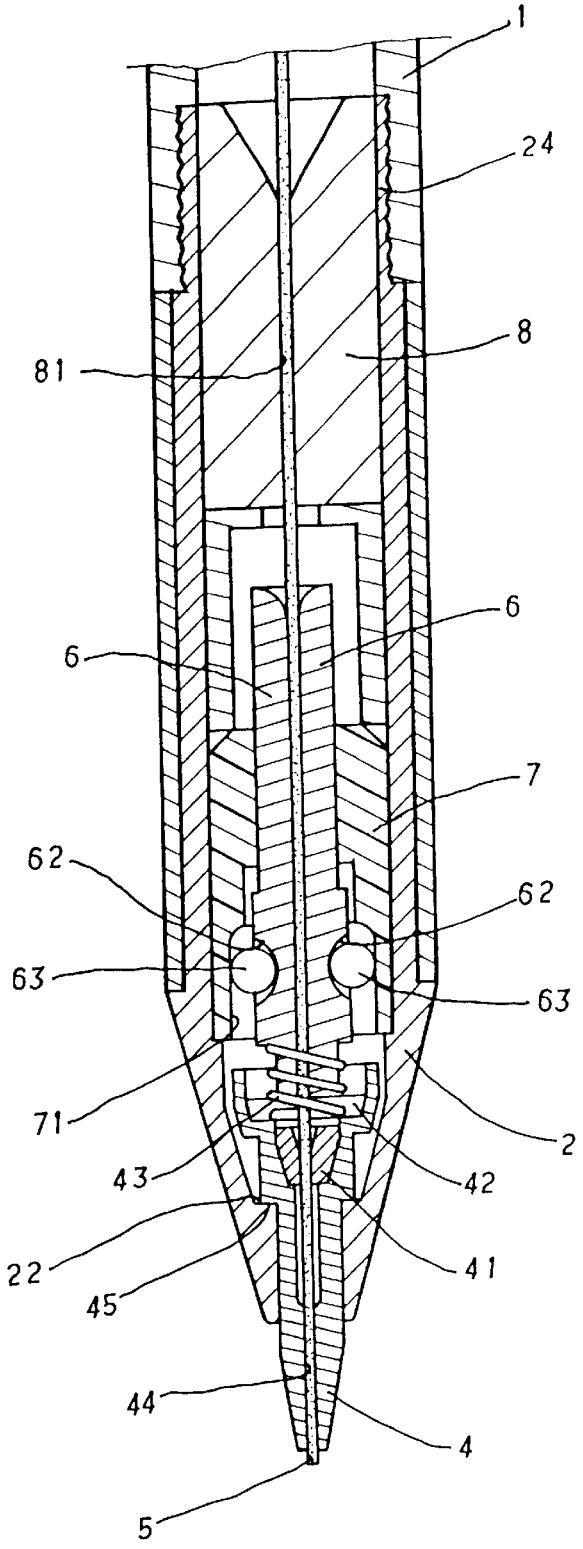
FIG. 11 is a front plan cross-sectional view of the automatic pencil structure in accordance with the further embodiment of the present invention.

Referring now to FIGS. 10 and 11, in accordance with a further embodiment of the present invention, the tip cover 2 is integrally formed with the connecting barrel 3, and the top of the tip cover 2 is formed with a threaded tube 24 screwed in the barrel 1 so that the tip cover 2 can be assembled with the barrel 1 easily and rapidly.

Accordingly, the automatic pencil structure of the present invention has the following advantages.

The connecting barrel 3 is assembled with the barrel 1 by means of the outer thread 31 and the inner thread 11 so that the connecting barrel 3 can be detached from the barrel 1 easily and quickly.

The inner diameter of each of the passage 81 of the conducting tube 8 and the pencil lead hole 73 of the clamp ring 7 is equal to the outer diameter of the pencil lead 5 so that only one pencil lead 5 can pass through the passage 81 and the pencil lead hole 73, thereby preventing multiple pencil leads 5 being blocked in the passage 81 and the pencil lead hole 73 so as to increase the lifetime of the automatic pencil structure.

It should be clear to those skilled in the art that further embodiments may be made without departing from the scope of the present invention.

What is claimed is:

1. An automatic pencil structure comprising:

a barrel (1), a tip cover (2), a connecting barrel (3), a slide member (4), a spring (43), a pencil lead (5), a clip member (6), a clamp ring (7), and a conducting tube (8), wherein, said barrel (1) is provided with an inner thread (11);

said tip cover (2) has a rear portion provided with a sleeve (21) fitted in said connecting barrel (3) and a front portion for receiving said slide member (4);

said connecting barrel (3) is provided with an outer thread (31) screwed in said inner thread (11) of said barrel (1), said connecting barrel (3) having a top defining a conducting hole (32) for receiving said conducting tube (8);

said slide member (4) having a front portion protruding outward from the front portion of said tip cover (2) and defining a through hole (44) for receiving said pencil lead (5) and a rear portion including a retaining ring (41) mounted therein for retaining said pencil lead (5) by a friction action;

said clip member (6) is located above said slide member (4) and defines a holding portion (61) for holding said pencil lead (5) therein, said clip member (6) having two opposite sides each defining an arcuate recess (62) for receiving a ball (63);

said spring (43) is mounted between said slide member (4) and said clip member (6) and has a front portion secured on said retaining ring (41) of said slide member (4) and a rear portion secured on said clip member (6);

said clamp ring (7) is secured in said sleeve (21) of said tip cover (2) and is enclosed around an outer periphery of said clip member (6), said clamp ring (7) having a bottom defining an inner inclined surface (71) urged on said two balls (63) and a top defining a locking hole (72) for securing a lower portion of said conducting tube (8), said locking hole (72) having a bottom having a center defining a pencil lead hole (73) for allowing passage of said pencil lead (5); and said conducting tube (8) is secured in said conducting hole (32) of said connecting barrel (3) and has its lower portion secured in said locking hole (72) of said clamp ring (7), said conducting tube (8) defining a passage (81) for receiving said pencil lead (5) therein, said passage (81) connecting to said pencil lead hole (73) of said clamp ring (7) and having a top defining an inner curved portion (82).

* * * * *